US011465405B2

(12) United States Patent
Riding et al.

(10) Patent No.: US 11,465,405 B2
(45) Date of Patent: Oct. 11, 2022

(54) DEVICE FOR GENERATING A PATTERN ON A CLOTHING FOR A MACHINE FOR MANUFACTURING A WEB MATERIAL

(71) Applicant: VOITH PATENT GMBH, Heidenheim (DE)

(72) Inventors: Paul Raymond Riding, Blackburn (GB); David Stuart Ponton, Blackburn (GB); Andrew Allum, Darwen (GB); Antony Morton, Ben Rhydding (GB)

(73) Assignee: Voith Patent GmbH, Heidenheim (DE)

( * ) Notice: Subject to any disclaimer, the term of this patent is extended or adjusted under 35 U.S.C. 154(b) by 361 days.

(21) Appl. No.: 16/780,181

(22) Filed: Feb. 3, 2020

(65) Prior Publication Data

US 2020/0173107 A1 Jun. 4, 2020

Related U.S. Application Data

(63) Continuation-in-part of application No. 15/662,481, filed on Jul. 28, 2017, now abandoned, which is a (Continued)

(30) Foreign Application Priority Data

Apr. 10, 2013 (DE) ..... 102013206273

(51) Int. Cl.
*B41F 15/12* (2006.01)
*D21F 1/00* (2006.01)
(Continued)

(52) U.S. Cl.
CPC ..... *B41F 15/38* (2013.01); *B05C 9/025* (2013.01); *B41F 13/10* (2013.01);
(Continued)

(58) Field of Classification Search
None
See application file for complete search history.

(56) References Cited

U.S. PATENT DOCUMENTS 5,782,178 A * 7/1998 Otomo ..... B41F 15/084 101/119
5,852,976 A * 12/1998 Coudert ..... B65H 9/06 101/328

(Continued)

FOREIGN PATENT DOCUMENTS

DE 4428670 A1 * 2/1996 ..... B41C 1/14
DE 102007024507 A1 11/2008

(Continued)

*Primary Examiner* — Leslie J Evanisko
(74) *Attorney, Agent, or Firm* — Laurence A. Greenberg; Werner H. Stemer; Ralph E. Locher

(57) ABSTRACT

A device for producing a pattern combination on a clothing includes the following: a rotary screen, a cylindrical jacket surface with a perforation pattern that defines a first pattern component. Material in the liquid or pasty state is pressed through the perforations of the jacket surface of the rotary screen and deposited on the surface of the clothing in order to produce the first pattern component on a surface of the clothing, while the rotary screen, rotating several times about a longitudinal axis thereof, rolls on the surface of the clothing in at least one path that continuously revolves on the surface of the clothing at least once. At least one device produces, synchronously and/or simultaneously, a second pattern component, which device is connected indirectly or directly to the rotary screen. The device for producing the pattern combination also includes a post-run system.

8 Claims, 2 Drawing Sheets

Related U.S. Application Data continuation of application No. 14/784,229, filed as application No. PCT/EP2014/057127 on Apr. 9, 2014, now abandoned.

(51) Int. Cl.

| | |
|---|---|
| ***B41F 15/38*** | (2006.01) |
| ***B41F 19/00*** | (2006.01) |
| ***B41F 13/10*** | (2006.01) |
| ***B41F 33/00*** | (2006.01) |
| ***D21F 1/44*** | (2006.01) |
| ***D21F 11/00*** | (2006.01) |
| ***B41F 15/08*** | (2006.01) |
| ***B05C 9/02*** | (2006.01) |
| *B41M 1/12* | (2006.01) |

(52) U.S. Cl.

CPC ..... *B41F 15/0836* (2013.01); *B41F 15/0868* (2013.01); *B41F 15/12* (2013.01); *B41F 19/002* (2013.01); *B41F 33/00* (2013.01); *D21F 1/0027* (2013.01); *D21F 1/44* (2013.01); *D21F 11/006* (2013.01); *B41M 1/12* (2013.01)

(56) References Cited

U.S. PATENT DOCUMENTS

| | | | | |
|---|---|---|---|---|
| 7,624,765 | B2 | 12/2009 | Burazin et al. | |
| 7,799,382 | B2 | 9/2010 | Payne et al. | |
| 8,470,133 | B2 | 6/2013 | Cuannane et al. | |
| 8,728,373 | B2 | 5/2014 | O'Connor | |
| 2004/0126544 | A1 | 7/2004 | Jaglowski et al. | |
| 2004/0126569 | A1 | 7/2004 | Davenport et al. | |
| 2007/0039490 | A1* | 2/2007 | Aichele ..... | B41F 15/0872 101/35 |
| 2007/0170610 | A1 | 7/2007 | Payne et al. | |
| 2008/0099170 | A1 | 5/2008 | Ostendorf et al. | |
| 2011/0250355 | A1 | 10/2011 | Allum et al. | |

FOREIGN PATENT DOCUMENTS

| | | | |
|---|---|---|---|
| DE | 102007033393 | A1 | 1/2009 |
| DE | 102008040973 | A1 | 2/2010 |
| EP | 0502239 | A1 | 9/1992 |
| EP | 1690981 | A1 | 8/2006 |
| EP | 1690982 | A1 | 8/2006 |
| FR | 610262 | A | 9/1926 |
| WO | 2008115682 | A1 | 9/2008 |

* cited by examiner

DEVICE FOR GENERATING A PATTERN ON A CLOTHING FOR A MACHINE FOR MANUFACTURING A WEB MATERIAL

CROSS-REFERENCE TO RELATED APPLICATION

This application is a continuation-in-part of application Ser. No. 15/662,481, filed Jul. 28, 2017, which was a continuation of patent application Ser. No. 14/784,229, which was a § 371 national stage filing of international application No. PCT/EP2014/057127, filed Apr. 9, 2014, which designated the United States; this application also claims the priority, under 35 U.S.C. § 119, of German patent application No. DE 10 2013 206 273.7, filed Apr. 10, 2013; the prior applications are herewith incorporated by reference in their entirety.

BACKGROUND OF THE INVENTION

Field of the Invention

The invention proceeds from a device and a method for generating a pattern on a clothing for a machine for manufacturing a web material, such as, for example, paper, cardboard, tissue, or a non-woven product, and from a clothing of this type.

A clothing of this type which may be employed as a forming wire in a paper machine, for example, is known from European published patent application EP 1 690 981 A1. In the case of this known paper machine clothing a pattern from a polymer material is applied in a screen printing method by means of a rotary screen to a carrier structure which is configured as a woven fabric, for example. The pattern having substantially any arbitrary design embodiment may be applied to the woven carrier fabric so as to thus generate by way of this pattern a surface structure on one side of the paper machine clothing manufactured in this way.

A method for applying a pattern to a paper machine clothing is known from European published patent application EP 1 690 982 A1, in which method a polymer material forming the pattern is dispensed in an extrusion operation from an extrusion head and is thus applied to the surface of a carrier structure which may be of a woven fabric type, for example. The extrusion head may be arbitrarily moved above the surface of the carrier structure.

Furthermore, a clothing for a paper machine, in which a basic structure is repeatedly printed with a polymer structure is known from published patent application US 2008/099170 A1, for example, wherein a first polymer layer has a grid-type structure and a second polymer layer largely occupies the clearances in the grid-type first layer and thereby partially superimposes the first layer.

U.S. Pat. No. 7,624,765 B2 discloses a woven paper machine clothing for perfused air drying which has a three-dimensional woven pattern which has a structure which has height differences in the direction z of 0.2 mm or more. The clothing has decorative elements which are surrounded by accentuation areas which are surrounded by the three-dimensional woven pattern of the clothing and have a structure which has a lower height than the structure of the woven pattern. The woven pattern represents a structured background surface which is the prevailing contact area of the clothing with the paper web.

It is particularly disadvantageous in known clothings and the manufacturing methods thereof here that combinations of patterns are indeed possible by correspondingly manufacturing and subsequently printing the basic structure, but that this is very complex. Multiple printing operations on a structured or non-structured base structure are also known, as has been mentioned earlier, but the former have the same disadvantage. In particular the clothings last mentioned have to be subjected to multiple processing, causing high manufacturing costs and a high investment in time.

BRIEF SUMMARY OF THE INVENTION

It is thus an object of the present invention to state a method and a device by way of which various patterns may be simultaneously applied to the surface of a clothing in a simpler and thus more rapid and more cost-effective way, such that multiple steps for manufacturing a pattern are not necessary. On account thereof, processing time may be saved and manufacturing of such clothings may be designed to be more economical.

The object in terms of the device is achieved by the device as claimed, in terms of the method by the method as claimed, and in terms of the clothing by the clothing as claimed, in each case in combination with the generic features.

According to the invention it is provided here that the device comprises at least one rotary screen, the cylindrical sleeve face of which has a perforated pattern which determines a first pattern component and in which, for generating the first pattern component on a surface of the clothing, a material in a liquid or pasty state is squeezed through the perforations of the sleeve face of the rotary screen and is deposited on the surface of the clothing, while the rotary screen, repeatedly rotating about the longitudinal axis of the same, rolls over the surface of the clothing on at least one path which continuously encircles the surface of the clothing at least once. Furthermore, at least one means for generating in a synchronous and/or simultaneous manner a second pattern component is provided, said means being indirectly or directly connected to the rotary screen. Pattern generation is regulated by way of a follower system.

On account of the synchronous and/or simultaneous application of the two pattern components, very swift and time-saving manufacturing of the clothing may be performed in just one operational step. On account of a suitable configuration of the rotary screen and of the at least one means for generating the second pattern component, which is connected to said rotary screen, a large diversity of patterns which are manufacturable in a simple way and without undesirable misalignments on clothings of arbitrary widths is available.

Further advantageous aspects and refinements of the invention are derived from the dependent claims.

According to one preferred embodiment of the invention the at least one means for synchronously and/or simultaneously generating the second pattern component may be configured in the form of at least one pattern ring.

Particularly preferably, the at least one pattern ring may be disposed on the rotary screen so as to be at the end thereof, and may be fixedly connected to the rotary screen. On account thereof, the pattern components are fixedly interconnected, avoiding misalignments in the pattern.

According to one aspect of the invention it may be provided that one pattern ring is present per end of the rotary screen.

According to one further aspect of the invention it may be provided that a plurality of pattern rings are present. These may be provided individually or in pluralities thereof at one or both of the two ends of the rotary screen.

At least one surface shape, in particular a channel, may be advantageously provided in the at least one pattern ring which surface shape extends circumferentially on a surface of the pattern ring.

The channel may preferably have a straight, curved, undulated, or zigzag shape. On account thereof, corresponding background patterns may be generated.

According to one further advantageous embodiment of the invention, the means for generating the second pattern component may have a pattern identification device by way of which the first pattern component is detectable. On account thereof, using an extrusion unit which is guided in a parallel manner, for example, the second pattern component may be applied relative to the first pattern component, this nevertheless being performed in only one operational step, without the clothing having to pass through a second separate printing process.

According to one advantageous aspect of the invention it may be provided that the follower system is indirectly or directly linked to the at least one means for synchronously and/or simultaneously generating the second pattern component.

Particularly advantageously, the shape of the at least one pattern ring may be mechanically or optically traceable by the follower system.

Particularly preferably, an extrusion head which has one or a plurality of nozzles by way of which material is deployable onto the surface of the clothing is integrated in the follower system.

According to one advantageous refinement of the invention the follower system may have a controller by way of which identification of the pattern and actuation of the extrusion head is performed.

It may be advantageously provided that the first pattern component is composed of a first material, and the second pattern component is composed of a second material, wherein the first and the second material are identical to or different from one another. If and when various requirements are set for the pattern components, it may be advantageous for one of the materials to be harder or softer, more resistant to wear, smoother or coarser, than the other material.

In the same way, a cross-sectional shape of the first pattern component, and a cross-sectional shape of the second pattern component may advantageously be identical to or different from one another. On account thereof, for example, personalized motifs may be intensely and clearly highlighted, and may be surrounded by a background which has been drawn to be softer and less prominent.

The material of the pattern components may preferably contain or be composed of: amide, ester, silicone, polyurethane.

Sizing of the second pattern component may advantageously be at a height of 0 to 10 mm, at a width of 0.1 to 10 mm, and at an arbitrary length.

The lines of the second pattern component may be configured so as to be optionally continuous or discontinuous. On account thereof, a high degree of flexibility and individualization of the clothing and of the final product manufactured are enabled.

The invention will be explained in more detail in an exemplary manner in the following with reference to the figures and without limiting the general scope thereof.

DESCRIPTION OF THE INVENTION

Figure 1:
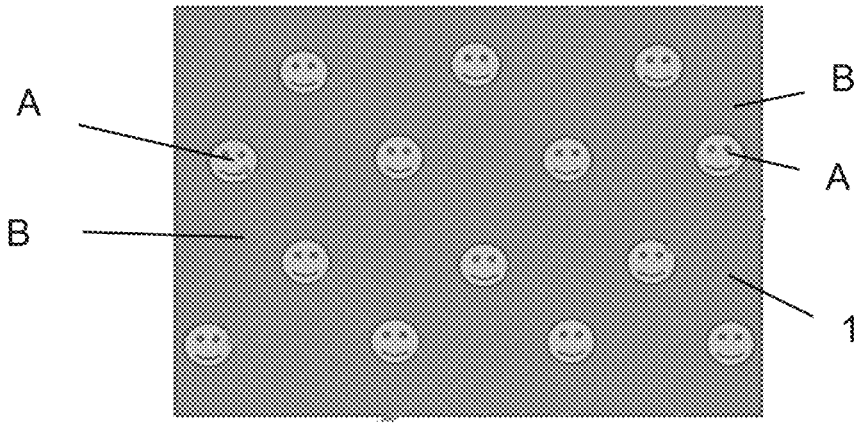
FIG. 1 shows a very schematized plan view of a clothing which has been manufactured by means of the method according to the invention.

A plan view of a clothing 1 which is particularly suitable for use in a machine for manufacturing a fibrous web, such as in a paper, cardboard, or tissue machine, as well as in a machine for manufacturing a non-woven product, is illustrated in a very schematized view in FIG. 1.

A plurality of clothings 1 which depending on their position fulfill various tasks are currently provided in such a machine. For instance, a clothing 1 in the forming section serves as a forming wire and thus for initially de-watering the fibrous suspension which has been sprayed onto the forming wire or has been injected between two forming wires in a double-wire former, and for orienting the fibers in the nascent fibrous web. Clothings 1 are provided as pressing felts for further de-watering in the downstream pressing section, which clothings 1 should have a high absorptive capacity for water, good resilience, smooth contact faces to the fibrous web, and a low tendency toward rewetting. The clothing 1 in the drying section is often configured as a drying wire in the shape of a helical structure and is distinguished by a high resistance to temperature at high permeability to vapor.

Clothings 1 also often serve for incorporating a decorative pattern into the fibrous web, this representing the current standard in the field of hygiene tissues in particular. The patterns here have both aesthetic features as well as features which influence the properties of the paper web, such as the grip of the surface, the thickness of the layers, etc.

The individual features here are often conceived such that a decorative and often also personalized pattern is desirable, but that the latter is not able to fulfill the requirements which are set for the physical properties of the fibrous web. It has thus been necessary to date for the clothing 1 to be subjected to at least two separate operational steps in order for at least two patterns to be manufactured in or on the respective clothing. For example, as mentioned at the outset, it is possible for a three-dimensional structure to be generated when manufacturing the basic structure of the clothing 1, and for this structure to be then superimposed by a pattern which is printed on at least one surface of the clothing 1, for example. The structure of the basic structure here may be manufactured by established weaving patterns, while the printed pattern is applied by a screen printing method, for example. Weaving of such basic structures is in particular a very complex process which moreover is very limited in terms of its diversity of patterns. Due to the nature of weaving, in each case only the machine direction, the machine cross direction, and diagonals may be incorporated into the pattern; an arbitrary selection of patterns is impossible.

Multiple printing, for example by screen printing, and subsequent printing by means of an extrusion nozzle device, are also known and possible. However, depending on the sizing thereof, it may take very long and/or be highly cost-intensive for a clothing 1 to be manufactured by means of such multi-stage methods.

According to the invention, it is therefore proposed that two pattern groups A and B are applied to the clothing 1 synchronously and/or simultaneously, using only one device, such that a regular or irregular pattern results from two different components, having a personalized motif and a background structure surrounding the motif, without complex weaving processes or a plurality of printing steps being necessary. Arbitrary planar structures such a woven fabrics, cross-laid structures, warp-knits, helical wires, helically coiled structures, and also films may be printable as a basic structure A personalized pattern component A, which is represented by the faces, is configured in front of a background of line-shaped structures which in the exemplary embodiment form a zigzag pattern B, and is shown in FIG. 1. Both pattern components A and B are composed of a material such as, for example, amides, polyurethane, silicone, esters, or other suitable materials which are capable of processing by printing or extruding, which material is dispensed from correspondingly designed extrusion devices onto the basic substrate of the clothing 1. The pattern component A here may be composed of the same material as the pattern component B, or of a material which is different therefrom. Selection of the materials may be performed according to the requirements pertaining to stability, sizing, smoothness, elasticity, gas and water permeability, etc., of the individual pattern components.

It is possible for arbitrary pattern components A and B to be combined, for example for personalized pattern components A, such as company logos, lettering, pictorial representations of arbitrary objects, etc., to be combined with pattern components B of straight lines, undulated lines, zigzag lines, interrupted lines, or dots. Here, in a method which will be described in more detail below, application of material of the pattern components A and B is precisely controlled, such that the personalized motif A is framed by the background pattern B.

The basic substrate may be available in the form of an endless belt or as a planar structure. Said basic substrate has to be correspondingly held or clamped by a suitable device, in order for the patterns A and B to be able to be applied to the former. If and when the basic substrate is available in the form of an endless belt, for example, it may be held and clamped by a combination of two or more rollers. The rollers may be rotatably mounted and be provided with a drive.

Figure 2:
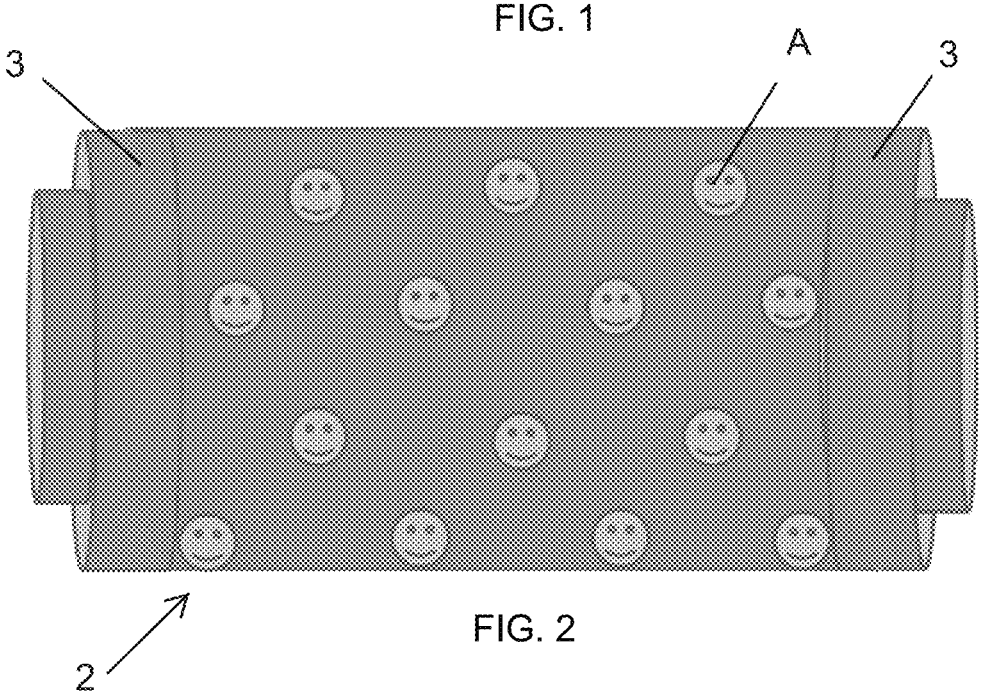
FIG. 2 shows a very schematized illustration of a rotary screen for manufacturing a clothing having two patterns.

Application of the pattern components A and B is performed according to one preferred embodiment of the invention, using a rotary screen 2 which is illustrated in a very schematized manner in FIG. 2. Rotary screens 2 of this type are already known from the prior art. Said rotary screens here are drum-shaped formations, for example from a thin sheet metal into which the pattern component A is incorporated in a suitable way, for example by punching or laser processing. The rotary screen 2 rolls on the basic substrate and thereby deploys material through the openings onto the surface of the basic substrate. If and when the basic substrate is substantially wider than the width of the rotary screen 2, the rotary screen 2 may be guided for a plurality of revolutions in a helical track in a transverse manner across the entire surface of the basic substrate. Sizing of the rotary screen 2 and a suitable controller system ensure that the pattern component A thus manufactured is free from misalignments and overlaps.

Figure 3:
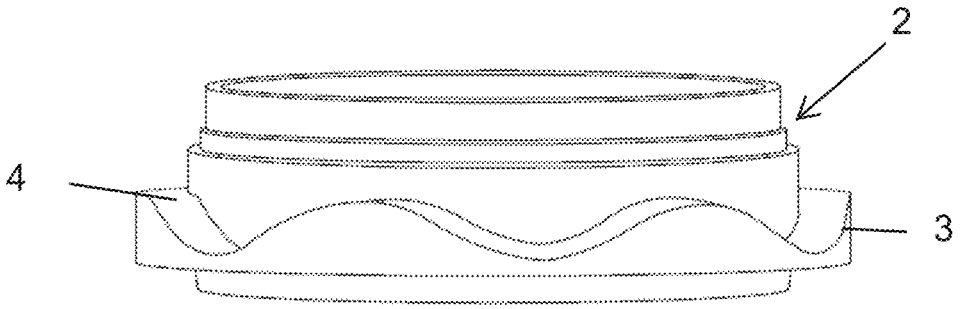
FIG. 3 shows a schematic perspective illustration of a pattern ring for use in a device according to the invention.

The second pattern component B, or the background pattern, in the exemplary embodiment is applied to the basic substrate using a guide system having pattern rings 3. The latter are disposed on the rotary screen 2 so as to be at the end thereof. A pattern ring 3 may be disposed only at one end of the rotary screen 2, however, in each case at least one pattern ring 3 may be provided on each end; a plurality of pattern rings 3 per end may also be combined. This at least one pattern ring 3 has the characteristic shape of the background pattern B, as may be seen in FIG. 3. In the present exemplary embodiment the line-based geometry is determined by a channel 4 in the pattern ring 3. The channel 4 may be incorporated into the pattern ring 3 by milling or laser processing, for example.

The material for generating the background pattern B is supplied to the at least one pattern ring 3 by a suitable supply system and is deposited on the basic structure.

One of the great advantages of this assembly lies in that the pattern-generating structures for the motif A and the background B are fixedly interconnected. This permits a high degree of controlled precision during application of the pattern and also allows for complex combinations. Consequently, the motif A and the background B are always mutually disposed and delimited in an accurate manner; the motif A is cleanly framed by the background B, and the patterns A and B do not mutually overlap on account of undesirable and unintentional misalignments when the material is being applied.

A suitable controller system may be used in order to automatically prompt the start and the end of the background pattern B, such that clean separation of the motif A and the background B is ensured. Optionally, it is of course also possible for the motif A and the background B to be mutually contacting, intersecting, or superimposing, if required, depending on which properties are desired with a view to the design and the technical requirements of the pattern components A and B.

The geometry of the background B and the disposal of the same are determined by the pattern rings 3. A follower system, which may be mechanically or optically operated, may be used for tracking the shape of the at least one pattern ring 3, for example the channel 4. An extrusion head, which may have one or a plurality of nozzles, is integrated in the follower system and is actuated by suitable controller means such that application of the material in each case starts and ends at the desired point.

In order for the motifs A to be exposed, the one nozzle or the plurality of nozzles of the extrusion head may be activated or deactivated, so as to allow or restrict the dispensing of material. This is synchronized with the position of the motif A in the rotary screen 2.

The completed clothing 1, after having been completely printed, contains a simultaneously manufactured pattern composed of the components A and B.

Typical sizings of the pattern component B may be selected as is described in the following:

Height: 0 mm (in this case the pattern B does not stand proud of the surface of the basic substrate but completely sinks thereinto) up to 10 mm Width: 0.1 mm to 10 mm Length: arbitrary combinations of line lengths (from very short or punctiform, respectively, up to very long or continuous, respectively) across the circumferential length of the basic substrate are conceivable and possible (in the case of an endless belt). The lines may be continuous if no large-scale motif A is envisaged. The end result thus may be any combination of continuous and discontinuous lines B, and regions with and without a motif A.

Controlling the start and end of the background pattern B may be performed pneumatically, hydraulically, electrically, for example, or may comprise a suitable combination of the previously mentioned possibilities.

It would be also conceivable and possible for an image recognition device which is indirectly or directly connected to the rotary screen 2 to be provided as a means for generating the second pattern component B, which software-supported image recognition device recognizes the pattern component A, and by way of suitable linking to the follower system controls the application of the pattern component B. Recognition here may be performed by way of optical or mechanical sensors, for example tactile sensors.

Suitable actuation and linking must then be provided between the rotary screen 2, the image recognition device, and the follower system. The image recognition device may furthermore also be an integral component part of the follower system.

Figure 4:
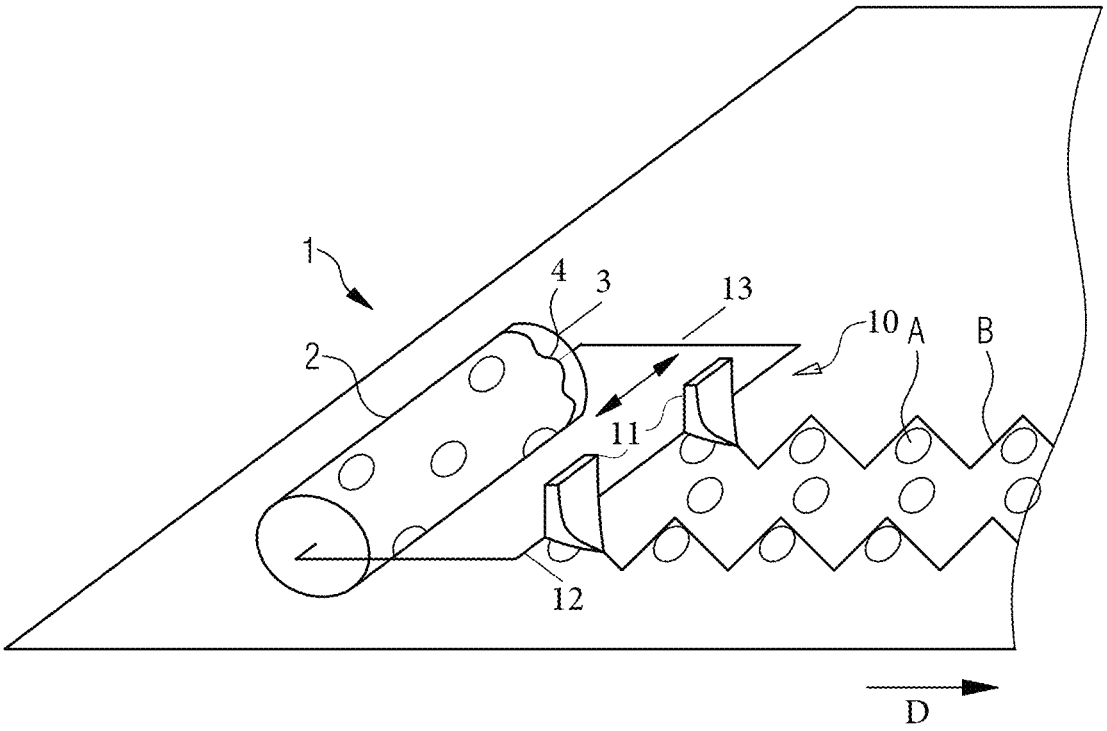
FIG. 4 is a schematic perspective illustration of an application of the device for printing a clothing web.

FIG. 4 shows an exemplary embodiment of a device according to one aspect of the current invention. A fabric 1, which may be a woven wire or a felt, moves in the direction D as indicated by the arrow. Here, a rotary screen 2 is used to apply a pattern A to the fabric 1. The pattern A illustrated here is a circular pattern. Here, a multitude of patterns can be provided, for example personalized patterns such a company logos letterings or pictorial representations of arbitrary objects. The generation of this pattern A is a screen printing process, where a material in liquid or pasty state is squeezed through perforations in the rotary screen. The material is usually a polymer material and may be chosen from the group of amides, polyurethane, silicone, esters, and other suitable materials.

The device further comprises a follower system 10. The follower system 10 also has a plurality of extrusion nozzles 11. These extrusion nozzles 11 are attached to a holder 12, usually a bar 12. The are disposed at a fixed distance. The extrusion nozzles are suited to generate a pattern B on the fabric. This pattern B is generated by nozzle extrusion of a material onto the fabric. The material for generating pattern B may be the same material as that for pattern A. It may also be a different material, but is usually also chosen from the group of amides, polyurethane, silicone, or esters.

In contrast to pattern A, which is due to the screen printing technology, preferably a set of discrete pattern elements, pattern B illustrated in FIG. 4 is a line shape pattern. By moving the extrusion nozzles 11, or the entire holder 12 in cross machine direction (CMD), the lines of pattern B may take the form of undulating lines or zigzag lines.

The patterns A and B are synchronized so as, for example, to avoid an unwanted superposition of the patterns. In order to realize the synchronization of pattern A and pattern B—for example to avoid an unwanted superimposing of these two patterns—a pattern ring 3 may be provided on at least one side of the rotary screen 2. The synchronization may be achieved by providing a channel 4 or groove 4 in the pattern ring 3. The connector bar 13 that connects the follower system 10 with the rotary screen 2 may be guided by this channel 4 or groove 4.

The channel 4 may for example have an undulating shape. By the rotation of the rotary screen 2, the undulation of the channel 4 forces the connector 13 and therefore also the follower system 10 to move back and forth in cross machine direction. So, the extrusion nozzles 11 deposit a pattern B in the form of undulating or zigzag-ing lines on the fabric.

By a suitably shaping the channel 4 in the pattern ring 3 it can be achieved that the patterns A and B remain in the desired relation to each other. The pattern ring 3 and the rotary screen 2, i.e., the applicator for the first pattern A, have a fixed structural relationship. Accordingly, the patterns A and B also have a fixed structural relationship.

While the use of a pattern ring 3 as described is a very easy and beneficial way to ensure the desired synchronization, other ways are also possible. For example, pattern rings 3 can be provided on both sides of the rotary screen 12.

Alternatively, the connection between the follower system 10 and the rotary screen 2 does not have to be a mechanical connection. It is also possible to use an optical system like a camera system. In such an embodiment, a camera would detect a pattern—may e.g. be the pattern A directly or some markings on the rotary screen—and initiate a cross directional movement of the follower system 10 based on this image information.

The invention is not limited to the illustrated exemplary embodiments. Combinations of the features in particular are possible and conceivable.

The invention claimed is:

1. A device for generating a pattern combination on a clothing, the device comprising:

a rotary screen having a longitudinal axis and a cylindrical sleeve face formed with a perforated pattern determining a first pattern component;

wherein, for generating the first pattern component on a surface of the clothing, a material in a liquid or pasty state is squeezed through perforations of the sleeve face of the rotary screen and is deposited on a surface of the clothing, while said rotary screen, repeatedly rotating about said longitudinal axis, rolls at least once over the surface of the clothing on at least one continuously encircling path on the surface of the clothing;

at least one device connected to said rotary screen and configured for generating a second pattern component; and a follower system linked to said at least one device for simultaneously generating the second pattern component; and an extrusion head with one or a plurality of nozzles integrated in said follower system and configured for deploying the material onto the surface of the clothing.

2. The device according to claim 1, wherein said at least one device for simultaneously generating the second pattern component is at least one pattern ring.

3. The device according to claim 2, wherein said at least one pattern ring is disposed on an end section of said rotary screen and fixedly connected to said rotary screen.

4. The device according to claim 2, wherein one pattern ring is disposed at each end of said rotary screen.

5. The device according to claim 2, which comprises a plurality of pattern rings.

6. The device according to claim 2, wherein said at least one pattern ring is formed with at least one surface shape extending circumferentially on a surface of said pattern ring.

7. The device according to claim 6, wherein said surface shape is a channel with a shape selected from the group consisting of straight, curved, undulated, and zigzag.

8. The device according to claim 1, wherein said at least one device for simultaneously generating the second pattern component is at least one pattern ring and a shape of said at least one pattern ring is mechanically or optically detectable and traceable by said follower system.

* * * * *